United States Patent [19]

Marte

[11] 3,989,457

[45] Nov. 2, 1976

[54] FINISHING PROCESSES FOR TEXTILE MATERIALS

[75] Inventor: Walter Marte, Ulisbach, Switzerland

[73] Assignee: Heberlein & Co. AG, Wattwil, Switzerland

[22] Filed: Mar. 17, 1975

[21] Appl. No.: 558,645

[30] Foreign Application Priority Data

Mar. 22, 1974 Switzerland ..... 4016/74

[52] U.S. Cl. ..... 8/182; 8/185; 8/195; 8/196; 8/116.4; 8/120; 8/DIG. 17

[51] Int. Cl.[2] ..... D06M 13/00; D06M 15/08

[58] Field of Search ..... 8/182, 185, 116.4, 195, 8/DIG. 17, 120, 196

[56] References Cited

UNITED STATES PATENTS

| | | | |
|---|---|---|---|
| 3,046,079 | 7/1962 | Reeves et al. | 8/116.4 |
| 3,533,728 | 10/1970 | Shippee et al. | 8/116.2 |
| 3,617,195 | 11/1971 | Moyse et al. | 8/116.3 |
| 3,852,829 | 12/1974 | Cicione et al. | 2/243 R |
| 3,854,866 | 12/1974 | Franklin et al. | 8/116 R |

*Primary Examiner*—John Kight, III

*Attorney, Agent, or Firm*—Larson, Taylor and Hinds

[57] ABSTRACT

A process is described for obtaining finishing effects on textile material consisting, at least partially, of cellulose fibers, without seriously reducing the tensile strength, tearing strength or wearing strength of the fibers. A finishing agent, capable of cross-linking with the hydroxy groups of the cellulose fibers, in a solution or emulsion containing a mixture of water and at least one organic solvent, such as low aliphatic ketones, aliphatic chlorinated hydrocarbons or low aliphatic esters, is applied to the textile material. The stability of the mixture is controlled by a salting-in or salting-out effect so as to induce a phase separation between aqueous and solvent phase, this effect being induced by the use of neutral salts, acid salts, potentially acid salts, organic acids, synthetic resins or reactants. The finishing agent is concentrated in the aqueous phase in the interior of the individual fibers while the surface zones retain the good surface properties of the starting material. Subsequently the textile material is heated to produce a wash-resistant fixation in the textile material.

14 Claims, No Drawings

FINISHING PROCESSES FOR TEXTILE MATERIALS

FIELD OF THE INVENTION

The present invention relates to a process for obtaining finishing effects based on cross-linkage to produce improved surface properties of textile material consisting, at least partially, of cellulose fibers.

Besides the reduction of tensile strength and tearing strength, the reduction of wearing strength has proved to be a considerable disadvantage in high finishing processes which produce an improvement of crease recovery in the dry or wet condition, non-ironing, dimensional stability, wash-resistant mechanical deformations and similar finishing effects by the increase of intermolecular bonds, particularly by cross-linking of cellulose-containing textile material.

Numerous attempts have been made to eliminate this disadvantage by using special combinations of finishing agents, the addition of softeners and other ingredients, or by the variation of the reaction conditions during cross-linking in order to improve the wear-resistance, but such measures, in practice, have failed to yield important improvements of the usefulness of the material.

SUMMARY OF THE INVENTION

It is the purpose of the present invention to provide a process for obtaining finishing effects based on cross-linkage of cellulose-containing textile material in which the reduction of wear-resistance can be avoided or at least reduced to a great extent. The process of the present invention is characterized in that finishing agents capable of cross-linking with hydroxy groups of cellulose are applied to the textile material in a solution or emulsion containing a mixture of water and at least one organic solvent, and in that the stability of the mixture is controlled so that, upon application, a phase separation and a concentration of the finishing agents passing into the aqueous phase is achieved in the interior of the fiber or of the fiber assembly, and in that a wash-resistant fixation of the finishing agent in the textile material is effected by heating.

According to the process of the present invention, the finishing agents and reaction catalysts are soluble in the water - solvent mixture at the usual application temperatures of between 20° and 25° C, i.e. there is a homogenous phase. The phase separation achieved by adequate control already occurs on the surface of the fiber assembly and of the individual fibers, and, as a consequence of the surface forces that appear and of the mutual effects occuring between fiber material and the aqueous phase which are also of a physical - chemical nature, the aqueous phase is concentrated preferably in the interior of the fiber and of the fiber assembly. On the other hand, the solvent phase which is practically free because of lack of solubility of the finishing agents therein is forced to concentrate on the surface of the fibers or of the fiber assembly. As organic solvents, solvents may be used the boiling temperatures of which are so much lower than the boiling temperature of water that, in the subsequent drying step, these solvents are evaporated first. Since remixing at higher temperature is a typically diffusion controlled process, provided the critical dissolution temperature of the system lies below the drying temperature range, during the time available, re-formation of a homogenous phase is rendered impossible. Thereby, localization of the finishing agents and of the reaction catalysts in the interior of the individual fibers and the fiber assembly is achieved so that, during the wash-resistant fixation of the finishing agents, the surface zones remain uncross-linked and retain the good surface properties of the starting material, especially abrasion resistance.

As finishing agents capable of cross-linking with the hydroxy groups of cellulose, primarily reactant resins such as acetals, for example reaction products of formaldehyde and diethylene glycol; dimethylol monocarbamates, for example dimethylol methyl carbamate; dimethylol urea and cyclic dimethylol urea compounds such as dimethylol compounds of ethylene urea, dioxyethylene urea, propylene urea; triazones such as 1,3-dimethylol-5-hydroxyethyl perhydrotriazone - 2; methylol - melamine compounds such as tetramethylol melamine or water-soluble etherified methylol melamine compounds; epoxydes such as for example diglycide ether of ethylene glycol, are suitable. Further suitable finishing agents are aldehydes such as formaldehyde, glyoxal, glutaraldehyde as well as epichlorhydrine, pyridinium compounds of chlorine methyl ethers, divinyl sulfone derivatives and tris - (1 - azridinyl) - phosphine oxyde, hexamethylene diethylene urea.

As organic solvents for the water/solvent mixture, aliphatic alcohols of between 1 and 8 carbon atoms in the chain, for example methanol, ethanol, isopropanol, n-butanol, amyl alcohol, are suitable. Further suitable organic solvents are low aliphatic ketones such as acetone, methyl - ethyl ketone, isobutyl ketone, low aliphatic esters, for example methyl acetate and ethyl acetate. Furthermore, mixtures of the various alcohols, ketones and esters may be used. For use in emulsions aliphatic chlorinated hydrocarbons, such as trichlorine ethylene and perchlorine ethylene, are suitable.

The stability of the water - solvent mixture may be controlled by the salting-out or salting-in effect of chemical agents such as neutral or acid or potentially acid salts or of organic acids which partially may at the same time also serve as reaction catalysts. For achieving a salting-out effect, sodium chloride is particularly suitable, furthermore magnesium chloride, magnesium nitrate, zinc chloride, zinc nitrate, aluminum chlorine hydrate are suitable. For achieving a salting-in effect, organic acids such as oxalic, citric, tartric, maleic, malonic and fumaric acid can be used. Furthermore, also synthetic resins and reactants having a salting-in effect can be used. Phase separation can be induced by a salting-out effect, preferably preimpregnation of the textile material with the aqueous solution of a neutral and/or acid or potentially acid salt being effected if necessary.

The water - solvent mixture may also contain substances inducing the salting-out or salting-in effect in masked form, such as thermally unstable metal complex compounds or insoluble salts held in suspension by protective colloids.

When using emulsions, it is furthermore possible to use thermal instability of the water - solvent mixture alone for controlling the mixture stability.

Furthermore, the water - solvent mixture may contain finishing auxiliary agents soluble in organic solvents most of which passes into the outer solvent phase. These auxiliary agents may be softeners, brighteners, hydrophobizers, hand modifiers.

The application of the water - solvent mixture containing the finishing agents onto the textile material may be affected with liquid adsorption of between 20 and 80%, preferably between 20 and 50% of the weight of the textile material.

The process according to the present invention may be applied on textile flat structures, particularly woven and knitted fabrics, of native cellulose such as cotton, furthermore regenerated cellulose or cellulose derivatives as well as on mixtures of these types of fibers. Furthermore, also mixed woven or knitted fabrics of cellulose fibers and of synthetic fibers such as for example cotton - polyester mixed woven fabrics may be used.

Furthermore, the textile flat structure, after application of the finishing agents and subsequent drying may be subjected to mechanical deformation, for example application of pleats and/or processing into wearing apparel and only afterwards to wash-resistant fixation of the finishing agents.

EXAMPLES OF THE INVENTION

The invention will hereinafter be explained in more detail by means of some examples:

EXAMPLE 1

A cotton warp satin fabric having been desized, boiled, mercerized and bleached was impregnated in the last rinsing bath after bleaching with an aqueous solution containing 80 g per liter of sodium chloride and dried. Thereafter, 180 g per liter of dimethylol dihydroxyethylene urea, 25 g per liter of magnesium chloride and 30 g per liter of a polyethylene softener, dissolved in a homogenous mixture of 150 ml of isopropanol, 100 ml of n-butanol and water were applied to a fabric cutting (sample 1). Hereby, the pick-up was increased by 45% of the dry weight of the fabric. Thereafter, the fabric was dried at 80° C whereupon, for achieving wash-resistant fixation of the finishing agent, the fabric was heated to 150° C for 4 minutes.

On a second cutting of the same fabric (sample 2) which had been pretreated as described above, an aqueous solution containing the same quantities of finishing agents and of catalysts was applied with the same liquid absorption, dried and fixed by means of heat under the same conditions.

The two treated fabric cutting as well as a third, untreated cutting were washed at 60° C with water containing 2 grams per liter of a non-ionogenic washing agent and dried, the evaluation of the fabric quality after washing being shown in the following table:

Table I

| | untreated | sample 1 | sample 2 |
|---|---|---|---|
| dry crease angle | 123° | 266° | 254° |
| wet crease angle | 108° | 280° | 291° |
| Wet crease appearance evaluation (Monsanto test) | 1 | 4,5 | 4,5 |
| Abrasion loss | 4,8 %* | 9,3 % | 20,2 % |
| Tensile strength | 22,6 kp | 14,6 kp | 13,2 kp |

*according to Swiss Standards Association test 198528 (1968, draft 4) (accelerotor abrasion: abrasion time 3 minutes, beating wings A-9060, emery-cloth 250 american, 3000 r.p.m.)

The fabric cutting treated according to the process of the present invention, when compared with the fabric cutting treated in conventional manner, shows, with the same crease angles and the same tensile strength, an essentially improved abrasion resistance.

EXAMPLE 2

A mercerized, bleached poplin mixed fabric containing 50% of cotton and 50% of polyester fibers was impregnated in the last rinsing bath after bleaching with an aqueous solution containing 80 g per liter of sodium chloride and dried. Thereafter, an oil-in-water emulsion consisting of 150 g per liter of hexamethylol melamine, 20 g per liter of magnesium chloride and 30 g per liter of polyethylene softener as well as of a mixture of 100 ml of amyl alcohol, 10 ml of isopropanol, water and a suitable emulsifying agent, was applied to a fabric cutting (sample 1), a pick-up of 45 weight percent of the dry weight of the fabric being thus effected. Thereupon, the fabric was dried at 80° C and heated to 150° C for 4 minutes.

A reference cutting (sample 2) was pretreated as described above and impregnated with an aqueous solution containing the same quantities of finishing agents, dried and fixed by heat treatment. The two treated fabric cuttings as well as a third, untreated cutting were, as described in example 1, washed and evaluated according to the following table II.

Table II

| | untreated | sample 1 | sample 2 |
|---|---|---|---|
| dry crease angle | 132° | 288° | 275° |
| wet crease angle | 107° | 273° | 274° |
| Monsanto note | 2 | 4,8 | 4,8 |
| abrasion loss | 3,6 % | 8,4 % | 16,3 % |
| tensile strength | 32,7 kp | 19,2 kp | 19,7 kp |

EXAMPLE 3

A cotton poplin fabric having been desized, boiled, mercerized and bleached was impregnated in the last rinsing bath after bleaching with an aqueous solution containing 50 g per liter of sodium chloride and 8 g per liter of zinc nitrate and dried. Thereafter, 150 g per liter of dimethylol propylene urea, 30 g per liter of a reactive polyacrylate softener, 4 g per liter of an optical brightener, which were dissolved in a homogenous mixture of ethanol and of amyl acetate in the ratio of 2 : 1 and in water, were applied to a fabric cutting (sample 1). Thereby, a pick-up of approximately 45 weight percent with respect to the dry weight of the fabric were coated onto the fabric. Finally, the fabric was dried at 80° C and heated for 4 minutes to 150° C.

A comparative cutting (sample 2) was pretreated as described above and impregnated with an aqueous solution containing the same finishing agent quantities and fixed by heating. The two treated fabric cuttings as well as a third, untreated cutting were, as described in example 1, washed and evaluated according to following table III.

Table III

| | untreated | sample 1 | sample 2 |
|---|---|---|---|
| dry crease angle | 121° | 284° | 286° |
| wet crease angle | 98° | 256° | 247° |
| Monsanto note | 1 | 4,5 | 4,5 |
| abrasion loss | 3,7 % | 13,4 % | 18,7 % |
| tensile strength | 31,7 kp | 18,9 kp | 17,3 kp |

EXAMPLE 4

For the treatment described in example 3, a treatment liquid was used which consisted of 160 g per liter of a dimethylol dihydrocyclic ethylene urea derivative, 30 g per liter of a reactive polyacrylate softener, 3 g per liter of maleic acid and 4 g per liter of an optical brightener which were dissolved in a homogenous mixture of ethanol and methyl ethyl ketone in the ratio of 1 : 2 and water. The maleic acid has, on one hand, a salting-in effect and on the other hand is active as reaction catalyst. The pick-up of the treatment liquid was 50 weight percent of the dry weight of the fabric. The impregnated and dried fabric (sample 1) was heated to 165° C for 30 seconds.

Sample 1, a comparative cutting treated with the aqueous treatment liquid & sample 2, and an untreated fabric cutting were washed as described in example 1 and evaluated according to following table IV.

Table IV

| | untreated | sample 1 | sample 2 |
|---|---|---|---|
| dry crease angle | 121° | 262° | 254° |
| wet crease angle | 98° | 287° | 256° |
| Monsanto note | 1 | 4,8 | 4,5 |
| abrasion loss | 3,7 % | 14,5 % | 23,4 % |
| tensile strength | 31,7 kp | 17,0 kp | 16,2 kp |

EXAMPLE 5

A mercerized, bleached mixed fabric containing 67% of cotton and 33% of polyamide 6.6 fibers was impregnated in the last rinsing bath after bleaching with an aqueous solution containing 5 g per liter of aluminum chlorine hydrate and 5 g per liter of magnesium chloride and dried. The metallic salts have on one hand a salting-out effect inducing the phase separation and on the other hand are active as reaction catalysts. A fabric cutting was impregnated with the treating liquid described in example 1, but containing no magnesium chloride, the coating being 30 weight percent of the weight of the dry fabric. The impreganted fabric was dried at 80° C and heated to 150° C for 4 minutes.

The abrasion losses of the thus treated fabric were 45% lower than those of the comparative cutting treated with an aqueous treatment liquid.

EXAMPLE 6

A mercerized, bleached cotton shirt fabric was impregnated in the last rinsing bath after bleaching with an aqueous solution containing 5 g per liter of maleic acid and dried. Thereafter, 200 g per liter of a methylol triazine derivative, 30 g per liter of a non-ionogenic softener, 4 g per liter of an optical brightener and 15 g per liter of magnesium carbonate which were dissolved in a homogenous mixture of 100 ml isopropanol, 200 ml of n-butanol and water, were applied to a fabric cutting (sample 1). Thereby, a pick-up of 40 weight percent of the dry weight of the fabric was effected. The magnesium carbonate was held in suspension in the treatment liquid by a suitable protective colloid, and the phase separation was effected by the dissolution of magnesium carbonate under liberation of carbonic acid, induced by the maleic acid, as a consecutive reaction. Finally, the fabric was dried at 110° C and heated to 160° C for 3 minutes.

A comparative cutting (sample 2) was pretreated as described above and impregnated with an aqueous solution containing the same quantities of finishing agents, dried and fixed by means of heat. The two treated cuttings as well as a third, untreated cutting were washed and evaluated according to the following table V.

Table V

| | untreated | sample 1 | sample 2 |
|---|---|---|---|
| dry crease angle | 87° | 251° | 250° |
| wet crease angle | 78° | 248° | 252° |
| Monsanto note | 1 | 4 | 4,2 |
| abrasion loss | 3,7 % | 7,1 % | 16,3 % |
| tensile strength | 22,8 kp | 14,5 kp | 15,0 kp |

EXAMPLE 7

A mercerized and bleached fabric of regenerated cellulose (spun rayon) was impregnated in the last rinsing bath after bleaching with an aqueous solution containing 12 g per liter of zinc nitrate and dried. Thereafter, an oil-in-water emulsion was prepared from 150 g per liter of a mixed resin of dimethylol dihydroxy ethylene urea and of urea - formaldehyde, of 20 g per liter of a non-ionogenic softener, 4 g per liter of an optical brightener as well as 200 ml of perchloroethylene, water and of a 3% emulsifier mixture and applied to the fabric. The pick-up was 45 weight percent of the dry weight of the fabric. Finally, the fabric was dried at 110° C and heated to 140° C for 3, 5 minutes.

The abrasion losses of the thus sreated fabric were 60% lower when compared with the comparative fabric cutting treated with an aqueous treatment liquid containing the same quantities of finishing agents.

The unit kp or kilopond used in this specification represents the weight of the unitary mass of 1000 grammes at a place of normal terrestial gravity.

I claim:

1. A process for obtaining finishing effects with improved surface properties on textile material consisting at least partially of cellulose fibers, the process comprising the steps of applying to the textile material a finishing agent, capable of cross-linking with the hydroxy groups of said cellulose fibers, and a reaction catalyst in a carrier containing a mixture of water and at least one organic solvent selected from the group consisting of aliphatic alcohols of 1 and 8 carbon atoms in the chain, low aliphatic ketones and low aliphatic esters, controlling the stability of said mixture by the salting-out or salting-in effect of a substance selected from the group consisting of neutral salts, acid salts, potentially acid salts and organic acids, whereby, upon application of said finishing agent in said carrier to said textile material, a phase separation between aqueous and solvent phases is effected and whereby a concentration of said finishing agent and of said reaction catalyst passing into the aqueous phase is effected in the interior of the cellulosic fibers of said textile material, and heating said textile material to produce a wash-resistant fixation of said finishing agent in said textile material.

2. A process according to claim 1, in which said carrier is an oil-in-water emulsion containing aliphatic chlorinated hydrocarbons.

3. A process according to claim 1, in which said substance selected from said group serves also as a reaction catalyst.

4. A process according to claim 1, in which said phase separation is induced by the salting-out effect of a substance selected from the group consisting of neutral salts, acid salts and potentially acid salts, said substance being applied by pre-impregnating said textile material.

5. A process according to claim 1, in which said chemical agent triggers said salting-out effect in masked form.

6. A process according to claim 1, in which said carrier containing said finishing agents is applied to said textile material in an amount resulting in a liquid pick-up by said fibers of between 20 and 80% (inclusive) by weight of said textile material.

7. A process according to claim 6, in which said liquid pick-up is between 20 and 50% (inclusive).

8. A process according to claim 1, in which said wash-resistant fixation of said finishing agent is effected after mechanical deformation of said textile material.

9. A process according to claim 1, in which said wash-resistant fixation of said finishing agent is effected after processing of said textile material into wearing apparel.

10. A process according to claim 1, in which said phase separation results in an aqueous phase concentrated in the interior of the cellulosic fibers of said textile material and an outer solvent phase concentrated on the surface of said fibers, and in which said mixture contains auxiliary agents selected from the group consisting of softeners, brighteners, hydrophobizers and hand modifiers dissolved in said organic solvents that pass into said outer solvent phase.

11. A process according to claim 1, in which said mixture contains aliphatic alcohols selected from the group consisting of methanol, ethanol, isopropanol, n-butanol, amyl alcohol.

12. A process according to claim 1, in which said phase separation is induced by the salting-out effect of at least one substance selected from the group consisting of sodium chloride, magnesium chloride, magnesium nitrate, zinc chloride, zinc nitrate, aluminium chlorine hydrate.

13. A process according to claim 1, in which said phase separation is induced by an organic acid selected from the group consisting of oxalic, citric, tartaric, maleic, malonic and fumaric acid.

14. A process according to claim 4, in which said phase separation is induced by the salting-out effect of an aqueous solution of sodium chloride.

* * * * *